US007571497B2

(12) United States Patent
Hetzler et al.

(10) Patent No.: US 7,571,497 B2
(45) Date of Patent: Aug. 11, 2009

(54) LAVATORY CARRIER

(75) Inventors: Roy Hetzler, Hendersonville, NC (US); Bushra Awad Ghaly, Burlington (CA)

(73) Assignee: Watts Regulator Co., North Andover, MA (US)

( * ) Notice: Subject to any disclaimer, the term of this patent is extended or adjusted under 35 U.S.C. 154(b) by 692 days.

(21) Appl. No.: 11/207,183

(22) Filed: Aug. 19, 2005

(65) Prior Publication Data

US 2006/0102813 A1 May 18, 2006

Related U.S. Application Data

(60) Provisional application No. 60/602,860, filed on Aug. 20, 2004.

(51) Int. Cl.
*A47K 1/05* (2006.01)

(52) U.S. Cl. ..... 4/645; 4/643; 4/648; 248/124.1; 248/149

(58) Field of Classification Search ..... 4/252.2, 4/252.3, 643, 645–648; 248/124.1, 124.2, 248/125.1, 149, 176.3; 269/51, 76–78
See application file for complete search history.

(56) References Cited

U.S. PATENT DOCUMENTS 2,035,301 A 3/1936 Daugherty
2,188,433 A * 1/1940 Friese ..... 269/78 X
2,264,082 A 11/1941 Kintz
2,283,794 A 5/1942 Crozier
2,810,917 A 10/1957 Rhoades, Jr.
2,819,473 A 1/1958 Baker et al.
3,012,250 A 12/1961 Morris et al.
3,810,597 A 5/1974 Flegel et al.
3,952,982 A * 4/1976 Lewis ..... 248/124.2
5,803,417 A * 9/1998 McNamara et al. ..... 248/149
6,276,648 B1 8/2001 Katz et al.

OTHER PUBLICATIONS

Wade Lavatory Carrier, Tyler Pipe webpage 2-7, Mar. 1, 1999.*

* cited by examiner

*Primary Examiner*—Robert M Fetsuga
(74) *Attorney, Agent, or Firm*—Fish & Richardson P.C.

(57) ABSTRACT

A lavatory carrier including at least one vertical upright, a horizontal cross plate, a clamp secured to the cross plate and releasably coupled to the upright, wherein the vertical position of the cross plate on the upright can be adjusted using the clamp, at least two horizontal arms for supporting a lavatory, and brackets secured to the arms and adjustably coupled to the cross plate. The positions of the arms, therefore, can be adjusted vertically and horizontally. In addition, horizontal positions of each of the arms on the cross plate can be independently adjusted using the brackets.

20 Claims, 7 Drawing Sheets

LAVATORY CARRIER

CROSS-REFERENCE TO RELATED APPLICATION

The present application claims priority from co-pending provisional U.S. Patent Application Ser. No. 60/602,860, filed Aug. 20, 2004, which is incorporated herein by reference in its entirety.

TECHNICAL FIELD OF THE DISCLOSURE

This disclosure relates to lavatory carriers and, more particularly, to a floor-mounted lavatory carrier having concealed uprights and arms, wherein the arms can be easily adjusted both horizontally and vertically during installation.

BACKGROUND OF THE DISCLOSURE

Lavatory carriers are used to support lavatories, such as sinks, that are not directly attached to a floor or a wall. One type of carrier includes vertical, floor-mounted uprights and horizontal arms that support the lavatory in a cantilevered manner. The vertical, floor-mounted uprights are concealed within a wall, while the arms extend horizontally from the uprights, through the wall, and are concealed within the lavatory. Some lavatory carriers allow the vertical position of the arms along the uprights to be adjusted during installation. In addition, the arms can include one or more leveling screws for leveling the lavatory.

What is still desired is a new and improved lavatory carrier. Among other advantages and benefits, the new and improved lavatory carrier will preferably allow fixed positions of separate parts of the carrier to be easily adjusted during installation of the carrier and attachment of the lavatory. For example, allowing arms of the carrier to be easily adjusted in both horizontal and vertical directions during installation is desirable. The easily adjustable parts can simplify installment of the carrier and reduce labor costs, among other benefits.

SUMMARY OF THE DISCLOSURE

The present disclosure provides a new and improved lavatory carrier including vertical uprights that are mounted on a floor and concealed within a wall of a building, and arms that extend horizontally from the uprights and out of the wall for supporting a lavatory against the wall in a cantilevered manner. Among other aspects and benefits, the new and improved lavatory carrier allows the arms to be independently adjusted in vertical directions with respect to the uprights, and allows the arms to be independently adjusted in horizontal directions away from and towards one another. Leveling screws for leveling the lavatory are provided on the arms and can be horizontally adjusted along the arms.

According to one embodiment, the lavatory carrier includes a horizontal plate adjustably coupled to the uprights with clamps. The clamps are slidably moveable vertically on the uprights and include fasteners for locking the clamps in vertical positions on the uprights. The arms, in-turn, are adjustably coupled to the horizontal plate with brackets. The brackets are slidably movably horizontally on the horizontal plate and include fasteners for locking the brackets in a horizontal position on the horizontal plate.

According to another embodiment, the leveling screws are coupled to the arms by clips configured for horizontal movement on the arms after mounting the lavatory to the arms. The clips include fasteners for locking the clips in a horizontal position on the arms. The arms each also include a locking member configured to lock the arm to the lavatory.

Additional aspects and advantages of the present disclosure will become readily apparent to those skilled in this art from the following detailed description, wherein only an exemplary embodiment of the present disclosure is shown and described, simply by way of illustration of the best mode contemplated for carrying out the present disclosure. As will be realized, the present disclosure is capable of other and different embodiments, and its several details are capable of modifications in various obvious respects, all without departing from the disclosure. Accordingly, the drawings and description are to be regarded as illustrative in nature, and not as restrictive.

BRIEF DESCRIPTION OF DRAWINGS

Reference is made to the attached drawings, wherein elements having the same reference character designations represent like elements throughout, and wherein.

DETAILED DESCRIPTION OF AN EXEMPLARY EMBODIMENT

Figure 1:
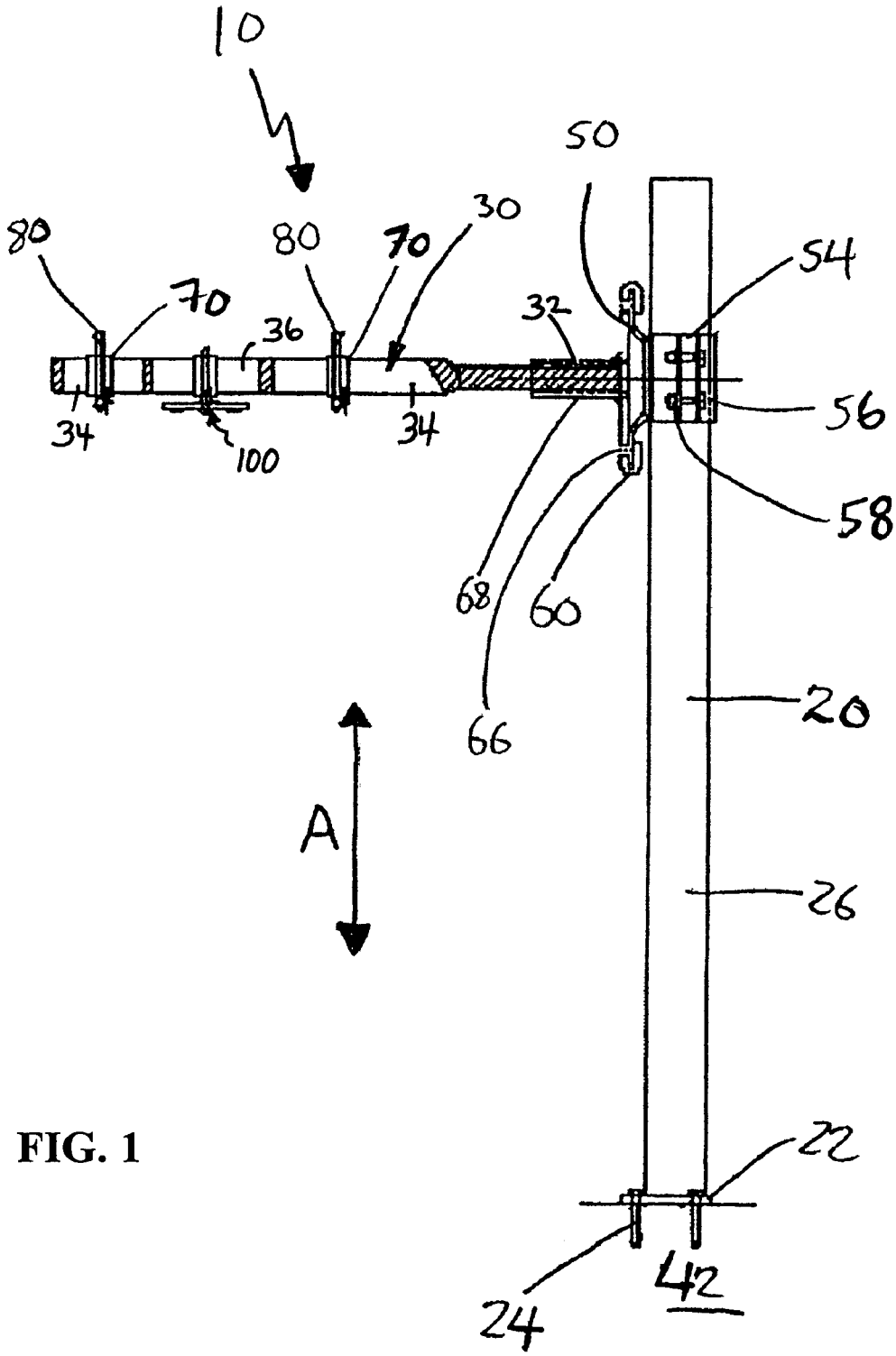
FIG. 1 is a side elevation view of an exemplary embodiment of a lavatory carrier constructed in accordance with the present disclosure, wherein an arm of the carrier is shown in section.
Figure 2:
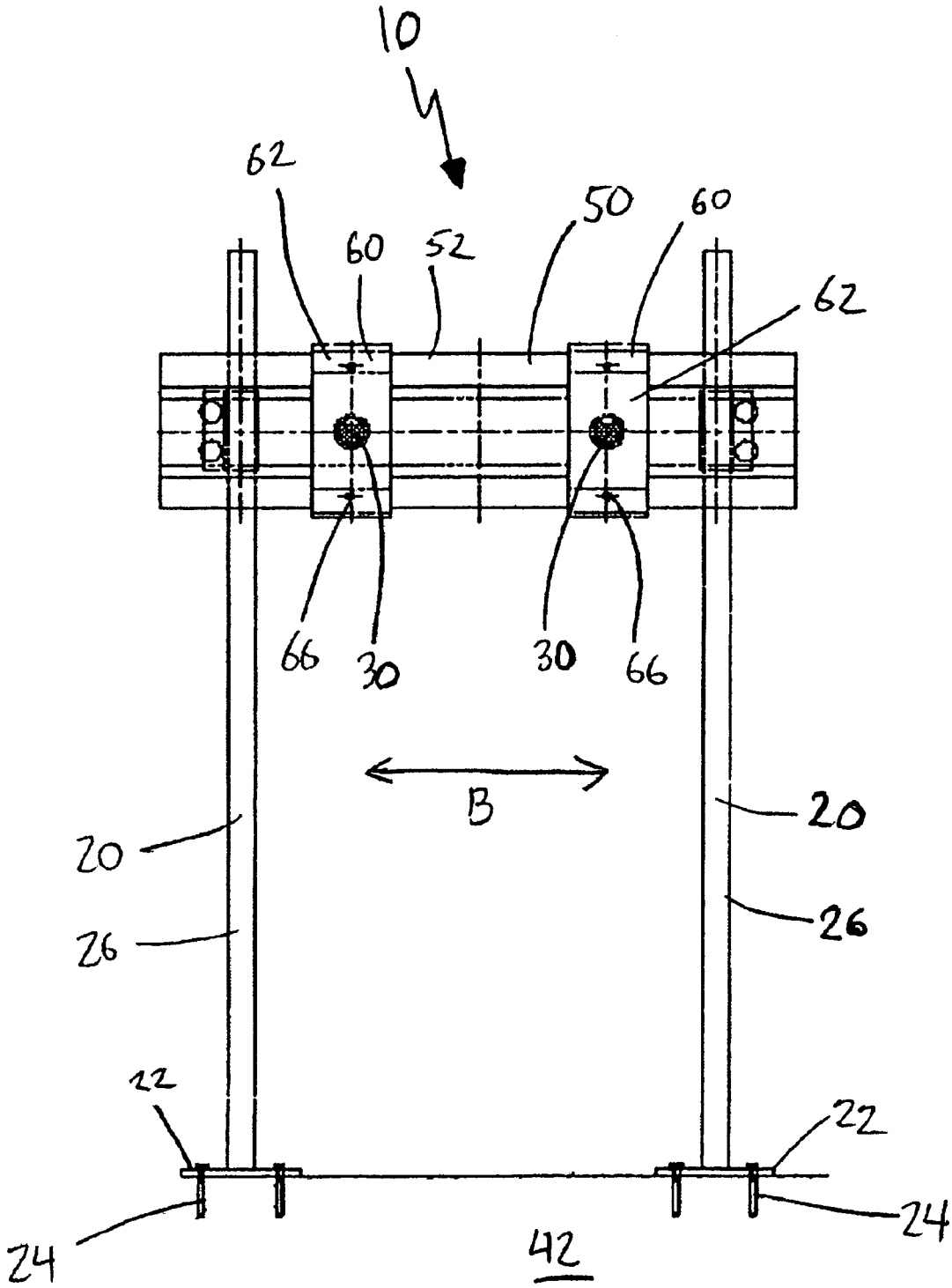
FIG. 2 is a front elevation view of the lavatory carrier of FIG. 1, wherein the arms are cut-away.
Figure 3:
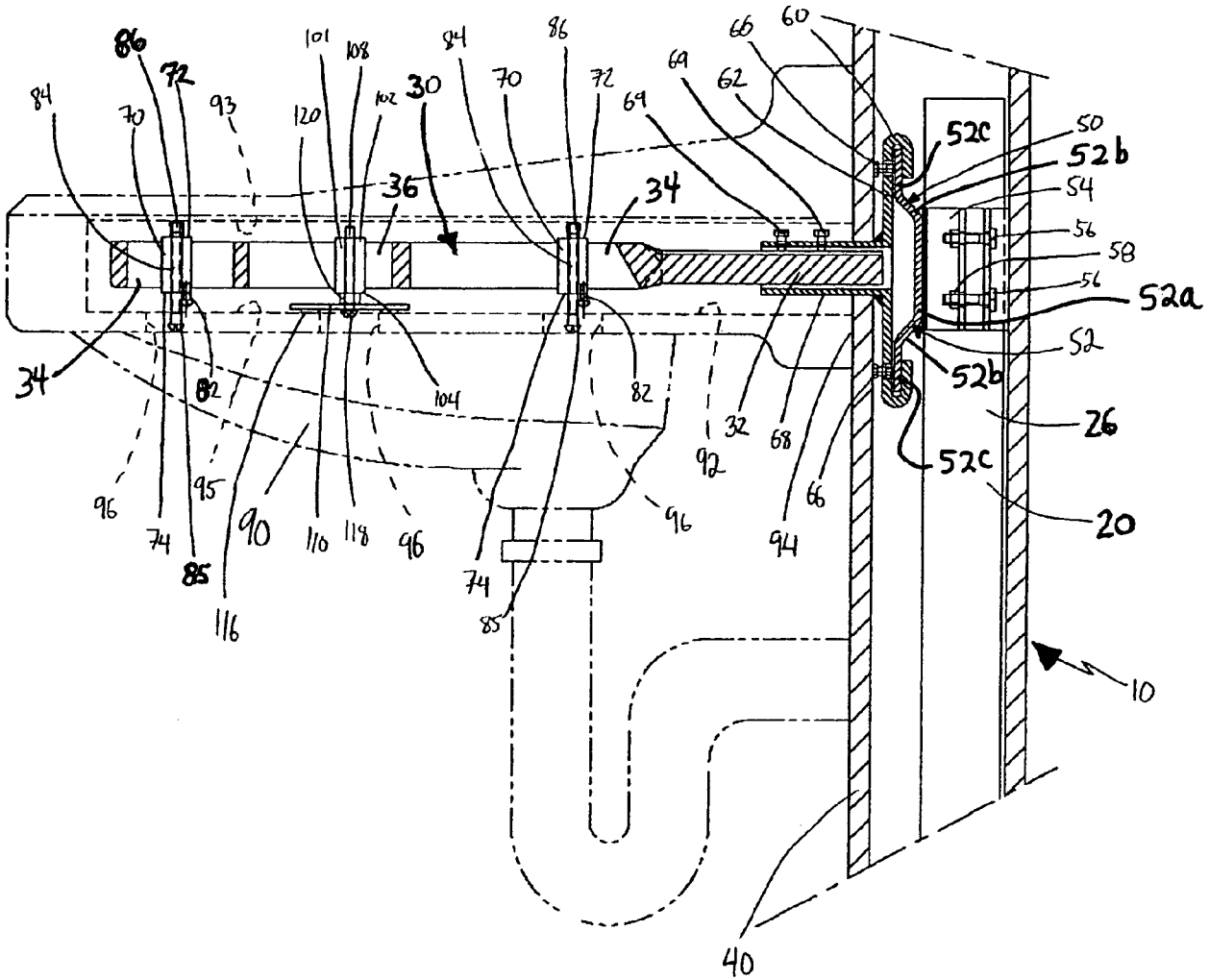
FIG. 3 is an enlarged, side elevation view, partially cut-away, of the lavatory carrier of FIG. 1 shown mounted within a wall with the arms extending out of the wall and supporting a lavatory.
Figure 4:
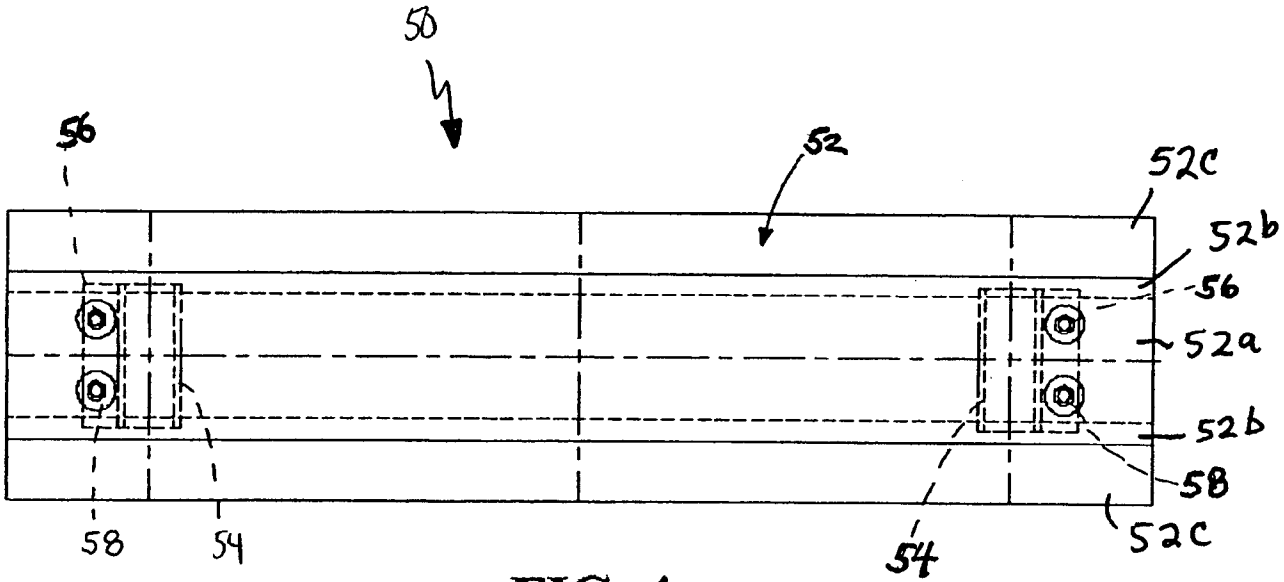
FIG. 4 is an enlarged front elevation view of a cross plate of the lavatory carrier of FIG. 1.
Figure 5:
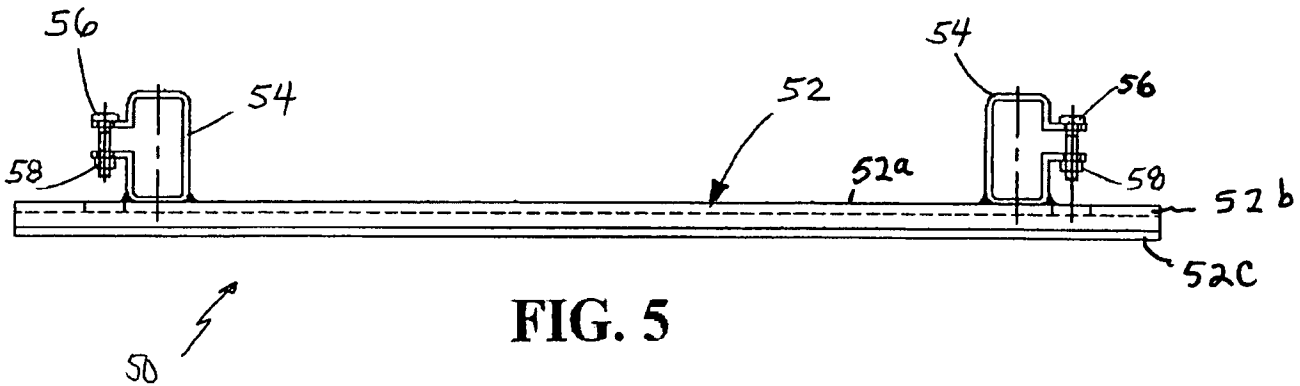
FIG. 5 is a top plan view of the cross plate of FIG. 4.

Referring to FIGS. 1 and 2, a lavatory carrier 10 includes a pair of vertical, floor-mounted uprights 20 and a pair of horizontal arms 30. As shown in FIG. 3, the uprights 20 are positioned within a wall 40 and the arms 30 extend through the wall 40 to attach to and support a lavatory 90, such as a sink. Extending horizontally between the uprights 20 and coupled to the arms 30 is a horizontal cross plate 50. Clamps 54 couple the cross plate 50 to the uprights 20 and are configured to allow vertical adjustment of the cross plate 50 on the uprights 20, as illustrated by arrow A in FIG. 1. Brackets 60 couple the arms 30 to the cross plate 50 and are configured to allow independent horizontal adjustment of the arms 30 on the cross plate 50, as illustrated by arrow B in FIG. 2. In the exemplary embodiment shown, the arms 30 extend horizontally at a 90° angle with respect to the horizontal cross plate 50.

In the exemplary embodiment shown in FIGS. 1 and 2, each upright 20 includes an elongated strut 26 secured to a base 22, which is in-turn secured to a floor 42. The struts 26 can be secured to the bases 22 using welds for example, and the base can be secured to the floor 42 using bolts 24 and bolt anchors for example. In the exemplary embodiment shown, the struts 26 have a hollow, rectangular cross-section, but may alternatively be provided with a solid cross-section and/or a different shaped cross-section.

The struts 26 are received through the clamps 54 to allow the plate 50 to be moved generally parallel to uprights 20, as illustrated by arrow A in FIG. 1, for adjusting the vertical position of arms 30. As shown, the clamps 54 have a rectangular cross-section that corresponds to the rectangular cross-section of the struts 26. Each clamp 54 includes releasable fasteners, such as a screw 56 and a nut 58, that can be tightened to lock the clamp 54 relative to the strut 26. Thus, with the arms 30 in their desired vertical position relative to strut 26, the screw 56 and the nut 58 are tightened to lock the clamp 54 to the strut 26.

Referring also to FIGS. 1-5, the cross plate 50 includes a plate member 52, and the clamps 54 are secured to the plate member 52, using welds for example. In the exemplary embodiment shown, the plate member 52 includes a base 52*a* secured to the clamps 54, walls 52*b* extending at an angle from the base, and wings 52*c* extending from the walls parallel with the base.

Figure 7:
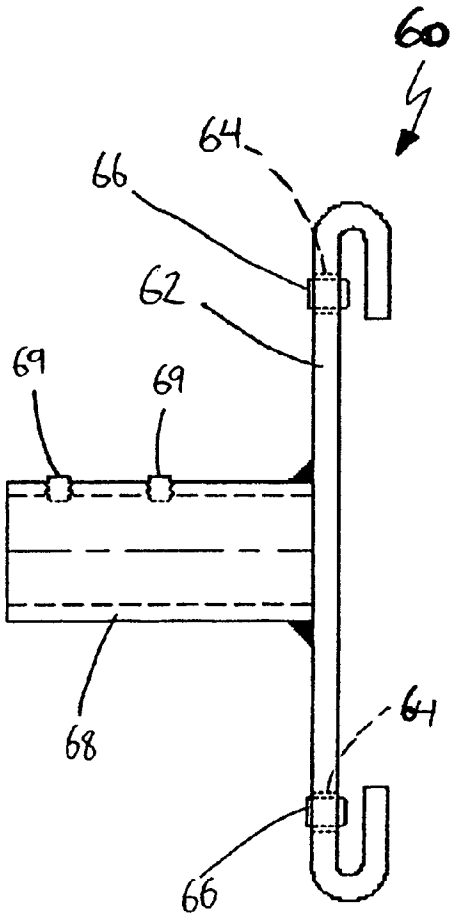
FIG. 7 is a side elevation view of the bracket of FIG. 6.
Figure 6:
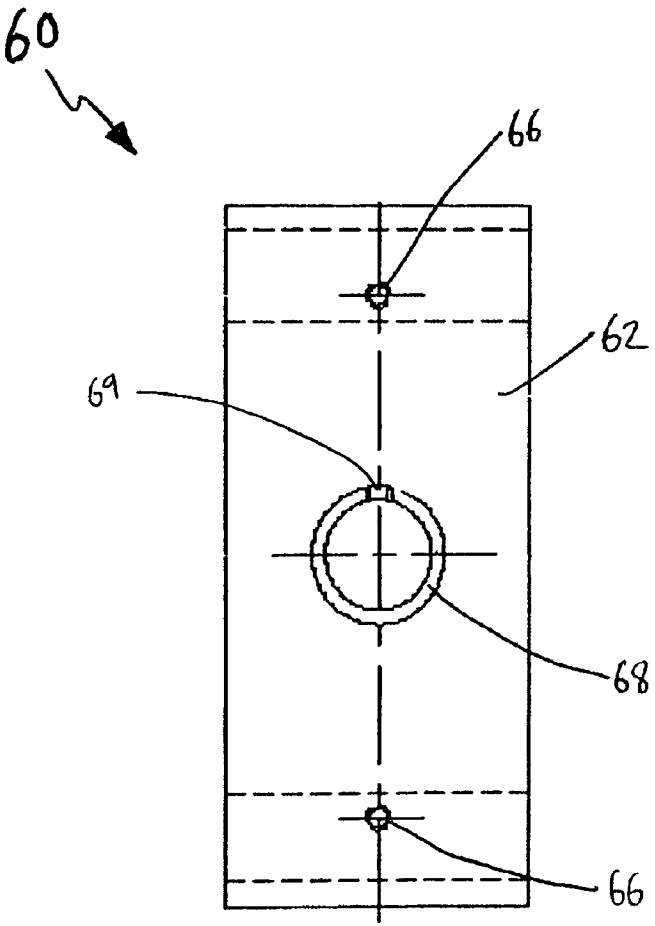
FIG. 6 is an enlarged front elevation view of a bracket of the lavatory carrier of FIG. 1.

Referring also to FIGS. 6 and 7, each of the brackets 60 includes a C-shaped plate portion 62 that receives the wings 52*c* of the plate member 52 of the cross plate 50 in a manner to permit the bracket 60 to slide along the cross plate 50, as illustrated by arrow B in FIG. 2. Extending from the plate portion 62 is a member 68 that secures to an end portion 32 of the arm 30. The member 68 is secured to the plate portion 62 with welds, for example. In the exemplary embodiment shown, the member 68 comprises a circular sleeve that receives the end portion 32 of the arm 30, which is a circular rod. Alternatively, the end portion of the arm 30 could be provided as a sleeve for receiving the member 68 which could be a circular rod.

Fasteners, such as setscrews, 69 lock end portion 32 of arm 30 inside sleeve 68. The plate portion 62 of each brackets 60 defines threaded apertures 64 that receive setscrews 66 that lock the bracket 60 in place along the cross plate 50.

Referring to FIG. 3, the lavatory 90 has a rear wall 94 in engagement with the building wall 40 and cavities 92 that extend through the lavatory 90 from the rear wall 94. The cavities 92, each bounded by a top wall 93 and a bottom wall 95, are sized and configured to receive the arms 30 of the carrier 10. The lavatory 90 also defines openings 96 extending through a bottom interior wall 95 of the lavatory 90 and intersecting the cavities 92. The opening 96 allow an installer access to the arms 30 within the lavatory 90 for positioning the lavatory 90, leveling the lavatory 90, and locking the lavatory 90 to the arms 30, as described below.

Figure 9:
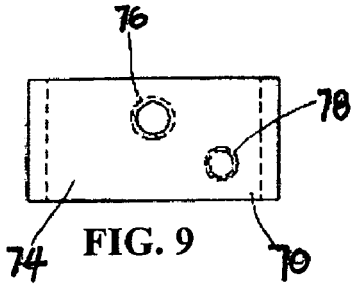
FIG. 9 is a bottom plan view of the leveling clip of FIG. 8.
Figure 8:
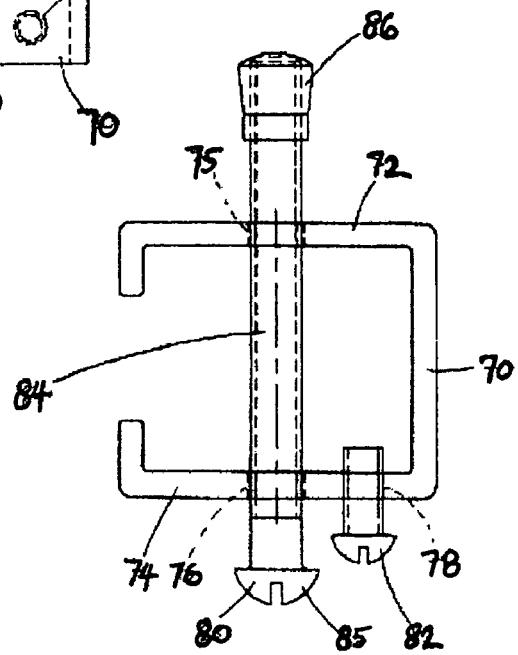
FIG. 8 is an enlarged side elevation view of a leveling clip of the lavatory carrier of FIG. 1, including a leveling screw and a setscrew.

Referring also to FIGS. 8 and 9, moveably coupled to each arm 30 are two leveling clips 70, each carrying a leveling member 80. The leveling clips 70 are C-shaped with a top wall 72, positioned opposite top wall 93 of lavatory 90, and a bottom wall 74 that is accessible through opening 96 of lavatory 90. Top and bottom walls 72, 74 define threaded leveling screw openings 75, 76 through which leveling member 80 is engaged. In the exemplary embodiment shown, the leveling member comprises a screw 80 having a head 85 on a shaft 84 that passes through a slot 34 in the arm 30, with a stopper 86 that engages lavatory 90 at 93. An installer adjusts the level of lavatory 90 by turning heads 85 of one or more of screws 80 to adjust the position of the stoppers 86 relative to lavatory 90.

Clip 70 is received by arm 30 in a manner to permit leveling clip 70 to be moved along the arm. Bottom wall 74 of clip 70 defines a threaded bore 78 for receiving a setscrew 82 for locking clip 70 in position relative to arm 30. The setscrew 82 is accessible through the opening 96 in lavatory 90. Thus, the positions of clips 70 and leveling screws 80 relative to arms 30 can be adjusted after lavatory 90 is positioned on the arms. In the exemplary embodiment shown, each of the arms 30 includes two slots 34 for receipt and movement of the clips 70. One of the arms is shown in detail in FIGS. 11-14.

Figure 10:
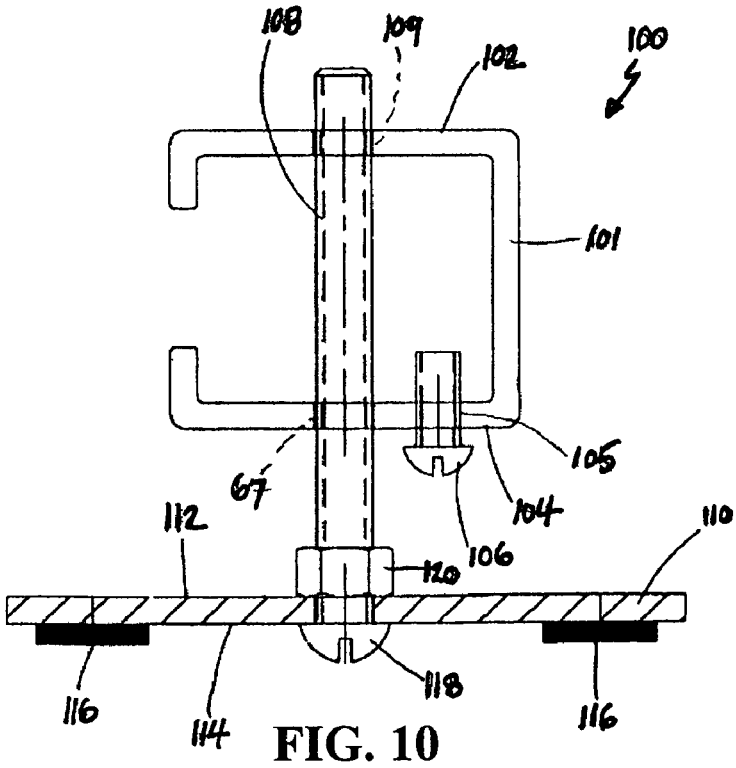
FIG. 10 is an enlarged side elevation view of a locking member of the lavatory carrier of FIG. 1, including a locking plate (shown in section), a leveling screw, and a setscrew.
Figure 11:
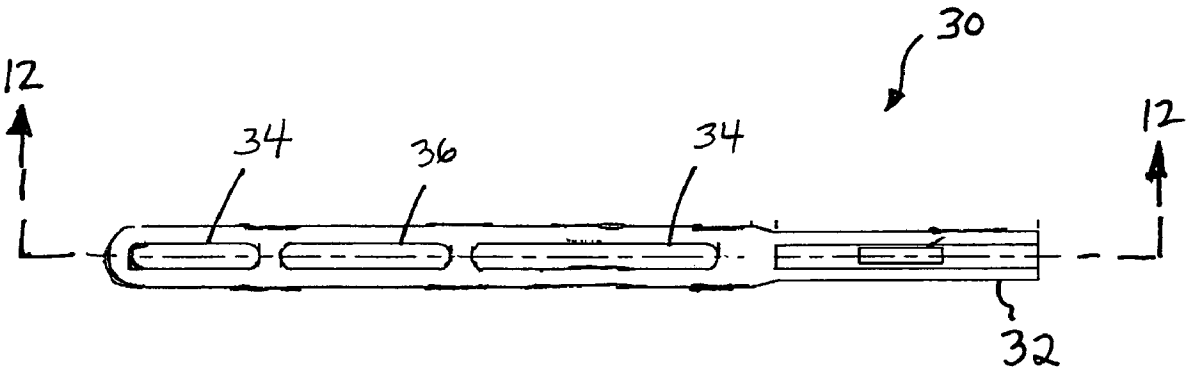
FIG. 11 is a top plan view of one of the arms of the lavatory carrier of FIG. 1.
Figure 12:
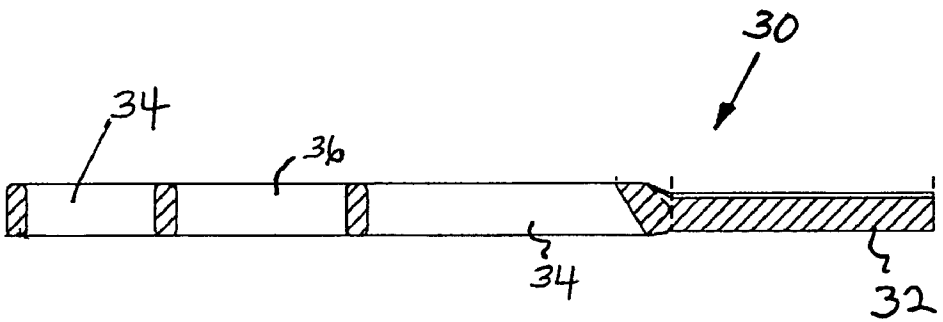
FIG. 12 is a sectional view of the arm taken along line 12-12 of FIG. 11.
Figure 13:
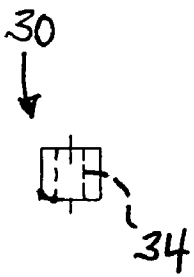
FIG. 13 is an end elevation view of the arm of FIG. 11.
Figure 14:
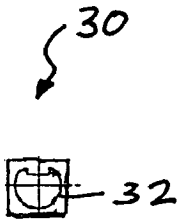
FIG. 14 is another end elevation view of the arm of FIG. 11.

Referring also to FIG. 10, coupled to each arm 30 is a locking member 100 for locking the arms 30 to the bottom wall 95 of the lavatory 90. The locking member 100 has a C-shaped body 101 with a top wall 102 facing the top wall 93 of the lavatory 90, and a bottom wall 104 that is accessible through the opening 96 of the lavatory 90. The body 101 receives the arm 30 in a manner to permit body 101 to be moved along arm 30. The bottom wall 104 of the body 101 defines a threaded bore 105 for receiving a setscrew 106 that locks the body 101 relative to the arm 30. The setscrew 106 is accessible through opening 96 in lavatory 90 to permit the position of body 101 to be adjusted after lavatory 90 is positioned on arms 30. Each of the arms 30 includes a central slot 36 for receipt and movement of the locking member 100.

The locking member 100 has a locking plate 110 positioned below bottom wall 104 and a threaded bolt 108 extending through plate 110 and through bores 67 and 109 in bottom wall 104 and top wall 102, respectively. The locking plate 110 has a top surface 112 facing the bottom wall 104 of the body 101 and a bottom surface 114 facing the bottom interior wall 95 of the lavatory 90. Mounted to the bottom surface 114 are rubber feet 116 configured to form a friction fit against the bottom interior wall 95. The bolt 108 has a head 118 positioned against bottom surface 114, with a nut 120 positioned against top surface 112. In use, the bolt 108 is turned to move the rubber feet 116 towards and into contact with the bottom interior surface 95 of lavatory, thereby to help secure arms 30 relative to lavatory 90.

Thus, the present disclosure provides a new and improved lavatory carrier 10. It should be understood, however, that the exemplary embodiment described in this specification has been presented by way of illustration rather than limitation, and various modifications, combinations and substitutions may be effected by those skilled in the art without departure either in spirit or scope from this disclosure in its broader aspects and as set forth in the appended claims. For example, the carrier may be constructed with a greater or a fewer number of uprights, cross plates, arm brackets, arms, leveling screws and/or leveling clips and locking members. Other types of fasteners may replace the setscrews described above, such as push fasteners, friction fit elements, and/or spring biased members. The carrier may be configured to allow adjustment of the arm position in directions other than parallel to and/or transverse to the uprights, such as at an angle to the uprights. The carrier may be formed of any suitable material such as metal, plastic or composite. Accordingly, other embodiments are within the scope of the following claims. In addition, the lavatory carrier 10 disclosed herein, and all elements thereof, are contained within the scope of at least one of the following claims. No elements of the presently disclosed lavatory carrier 10 are meant to be disclaimed.

What is claimed is:

1. A lavatory carrier comprising:

two vertical uprights;

a horizontal cross plate;

clamps secured to the cross plate and releasably coupled to the uprights, wherein the vertical position of the cross plate on the uprights can be adjusted using the clamps;

at least two horizontal arms for supporting a lavatory;

brackets couple the arms to the cross plate and are configured to allow independent horizontal adjustment of the arms on the cross plate; and at least one lavatory-leveling member moveably coupled to each arm, wherein the lavatory-leveling members are coupled to the arms through leveling clips adapted to allow horizontal positioning of the leveling members on the arms.

2. The lavatory carrier of claim 1, wherein the leveling clips are received in slots of the arms.

3. The lavatory carrier of claim 2, wherein the leveling clips include fasteners for securing the clips in horizontal positions on the arms.

4. The lavatory carrier of claim 1, further comprising locking members movably coupled to the arms for locking a lavatory onto the arms.

5. The lavatory carrier of claim 4, further comprising a lavatory supported on the arms, wherein the lavatory has cavities for receiving the arms and openings allowing access to the lavatory-leveling members and the locking member.

6. A lavatory carrier comprising:

two vertical uprights;

a horizontal cross plate;

clamps secured to the cross plate and releasably coupled to the uprights, wherein the vertical position of the cross plate on the uprights can be adjusted using the clamps;

at least two horizontal arms for supporting a lavatory; and brackets coupling the arms to the cross plate and configured to allow independent horizontal adjustment of the arms on the cross plate, wherein each of the brackets includes a C-shaped portion that receives wings of the cross plate in a manner to permit the bracket to slide on the cross plate, and the brackets include fasteners received in the C-shaped portion for locking the bracket in a desired position on the wings of the cross plate.

7. The lavatory carrier of claim 6, wherein each of the clamps receives the upright there through and includes a fastener adapted to lock the clamp in a position about the upright.

8. The lavatory carrier of claim 6, wherein each of the uprights includes an elongated strut having a hollow, rectangular cross-section.

9. The lavatory carrier of claim 6, wherein the brackets include sleeves that receive end portions of the arms.

10. The lavatory carrier of claim 9, wherein fasteners lock the end portions of the arms in the sleeves of the brackets.

11. The lavatory carrier of claim 6, further comprising at least one lavatory-leveling member moveably coupled to each arm.

12. The lavatory carrier of claim 11, wherein each of the lavatory-leveling members includes a leveling screw coupled to the horizontal arm by a leveling clip that is moveable relative to the arm.

13. The lavatory carrier of claim 12, wherein the clip includes a setscrew for locking the leveling clip in a position relative to the arm.

14. The lavatory carrier of claim 13, further comprising a lavatory supported on the arms, wherein the lavatory has cavities for receiving the arms and openings allowing access to the leveling screws and the setscrews of the leveling clips.

15. The lavatory carrier of claim 13, wherein the setscrews and the leveling screws extend through a bottom wall of the leveling clips.

16. The lavatory carrier of claim 11, further comprising a locking member movably coupled to each of the arms for locking a lavatory onto the arms.

17. The lavatory carrier of claim 16, wherein each of the locking members has a body received on the arm in a manner to permit the body to be moved horizontally along the arm, a fastener for locking the body in a horizontal position on the arm, a locking plate for clamping the lavatory to the arm, and a threaded bolt extending through the locking plate and received in a threaded bore of the body, whereby turning the thread bolt in one direction causes the locking plate to clamp the lavatory.

18. The lavatory carrier of claim 17, further comprising a lavatory supported on the arm, wherein the lavatory has a cavity for receiving the arm and openings allowing access to the leveling screw and the setscrew of the leveling clip, and the threaded bolt and the fastener of the locking member.

19. The lavatory carrier of claim 6, further comprising at least one lavatory-leveling member moveably coupled to each arm for leveling a lavatory received on the arms, and a locking member movably secured to each arm for locking the lavatory on the arm.

20. The lavatory carrier of claim 6, further comprising a lavatory secured to the arms.

* * * * *

UNITED STATES PATENT AND TRADEMARK OFFICE

CERTIFICATE OF CORRECTION

PATENT NO. : 7,571,497 B2
APPLICATION NO. : 11/207183
DATED : August 11, 2009
INVENTOR(S) : Roy Hetzler It is certified that error appears in the above-identified patent and that said Letters Patent is hereby corrected as shown below:

Col. 5, Line 33, in Claim 7, delete "there through" and insert -- therethrough --

Signed and Sealed this

Tenth Day of November, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,571,497 B2
APPLICATION NO. : 11/207183
DATED : August 11, 2009
INVENTOR(S) : Hetzler et al.

It is certified that error appears in the above-identified patent and that said Letters Patent is hereby corrected as shown below:

On the Title page,

[*] Notice: Subject to any disclaimer, the term of this patent is extended or adjusted under 35 U.S.C. 154(b) by 692 days.

Delete the phrase "by 692 days" and insert -- by 999 days --

Signed and Sealed this

Eighteenth Day of May, 2010

David J. Kappos

David J. Kappos
*Director of the United States Patent and Trademark Office*